US007998035B2

(12) United States Patent
Chen

(10) Patent No.: US 7,998,035 B2
(45) Date of Patent: Aug. 16, 2011

(54) KUNG FU TRAINING DEVICE

(76) Inventor: Yi-Lin Chen, Taichung (TW)

( * ) Notice: Subject to any disclaimer, the term of this patent is extended or adjusted under 35 U.S.C. 154(b) by 0 days.

(21) Appl. No.: 12/842,568

(22) Filed: Jul. 23, 2010

(65) Prior Publication Data

US 2011/0028279 A1 Feb. 3, 2011

(30) Foreign Application Priority Data

Jul. 28, 2009 (TW) ..... 98125375 A

(51) Int. Cl.
*A63B 69/28* (2006.01)
*A63B 69/34* (2006.01)

(52) U.S. Cl. ..... 482/83; 482/90

(58) Field of Classification Search ..... 482/83–90; 446/298, 336; 473/441–446; 472/128; 273/440.1
See application file for complete search history.

(56) References Cited

U.S. PATENT DOCUMENTS 4,387,892 A * 6/1983 Wen ..... 482/83
4,564,192 A * 1/1986 Lebowitz ..... 482/87
5,700,230 A * 12/1997 Cardona ..... 482/83
5,772,538 A * 6/1998 Sztykiel et al. ..... 473/446
7,357,760 B1 4/2008 Rios
7,828,701 B1 * 11/2010 Chen ..... 482/83
2002/0193211 A1 * 12/2002 Kao ..... 482/83
2004/0058787 A1 * 3/2004 Lin ..... 482/84
2007/0197348 A1 * 8/2007 Ku ..... 482/83
2009/0088302 A1 * 4/2009 Brenner et al. ..... 482/87
2009/0247374 A1 * 10/2009 Chen ..... 482/89
2009/0264262 A1 10/2009 Brenner et al.

* cited by examiner

*Primary Examiner* — Loan Thanh
*Assistant Examiner* — Daniel F Roland
(74) *Attorney, Agent, or Firm* — Muncy, Geissler, Olds & Lowe, PLLC

(57) ABSTRACT

A kung fu training device of the present invention mainly includes a base portion, a body portion and two arms. The body portion is disposed on the base portion. The body portion includes a vertical rod, a lateral rod and a wrapping element. The lateral rod is firmly disposed on the vertical rod. The wrapping element covers the rods. The arms are disposed on the body portion. The arms are height-adjustable and relative-distance-adjustable. As such, the kung fu training device is suitable for trainees with different body sizes, and almost whole training device can be attack by trainees without injury.

7 Claims, 5 Drawing Sheets

KUNG FU TRAINING DEVICE

BACKGROUND OF THE INVENTION

1. Field of the Invention

The present invention relates to a kung fu training device, more particularly to a durable and safe training device that can adjust the heights of and the relative distance between two hitting pads.

2. Description of the Prior Art

A typical kung fu training device is as disclosed in US2009/0264262. This kind of training device has a main frame for supporting several hitting pads which are adjustable for trainees, so that these training devices are durable and adjustable. To keep the function above, the main frame can not be covered by pads.

However, the training device is failed in protecting trainees. The main frame of the training device is exposed. Trainees, especially the rookies, may possibly hit the main frame to be injured. As a result, this kind of situation may stop the rookies' interest in kung fu.

There is another kind of training device disclosed in U.S. Pat. No. 7,357,760. This kind of training device does a better protection for trainees. Almost whole training device is covered by a pad. Unfortunately, this kind of training device is unable to be adjusted for trainees.

The present invention is, therefore, arisen to obviate or at least mitigate the above mentioned disadvantages.

SUMMARY OF THE INVENTION

The main object of the present invention is to provide a training device which is adjustable and safe to be used.

To achieve the above and other objects, a kung fu training device of the present invention includes a base portion, a body portion, two arms and tow first pins. The base portion has a seat portion extending upward. The body portion comprises a vertical rod, a lateral rod and a wrapping element. The vertical rod has a bottom end, a first body section and a top end. The bottom end is disposed on the seat portion. The first body section connects the bottom end to the top end. The lateral rod has two pivoting ends and a second body section. The second body section connects one of the pivoting ends to the other. The second body section is firmly disposed on the first body section. Each pivoting end is formed with a right polygonal hole and a first fixation hole. The right polygonal holes and the lateral rod are coaxial. The first fixation hole communicates with its corresponding right polygonal hole. The wrapping element is foamed material. The wrapping element covers the first body section, the top end, the pivoting ends and the second body section. The wrapping element is formed with two grooves. Each groove communicates with one of the first fixation holes. The right polygonal holes are uncovered, so that the right polygonal holes communicate with the surrounding. Each arm comprises a right polygonal rod, a stretching rod and a fist pad. Each right polygonal rod has plurality of side surfaces. Each side surface is parallel to the longitudinal direction of the right polygonal rod. Several of the side surfaces are formed with a set of bores. Each set of bores comprises plurality of first positioning holes. The first positioning holes of each set of bores are arranged along the right polygonal rod. Each right polygonal rod is received in one the right polygonal holes. Each first fixation hole communicates with one of the first positioning holes. A shoulder angle is defined by the right polygonal rod and the stretching rod. Each stretching rod connects its corresponding right polygonal rod to its corresponding fist pad. The first pins are removably inserted in the grooves, the first fixation holes and their corresponding first positioning holes, so that each right polygonal rod and their corresponding pivoting end are immovable with respect to each other.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
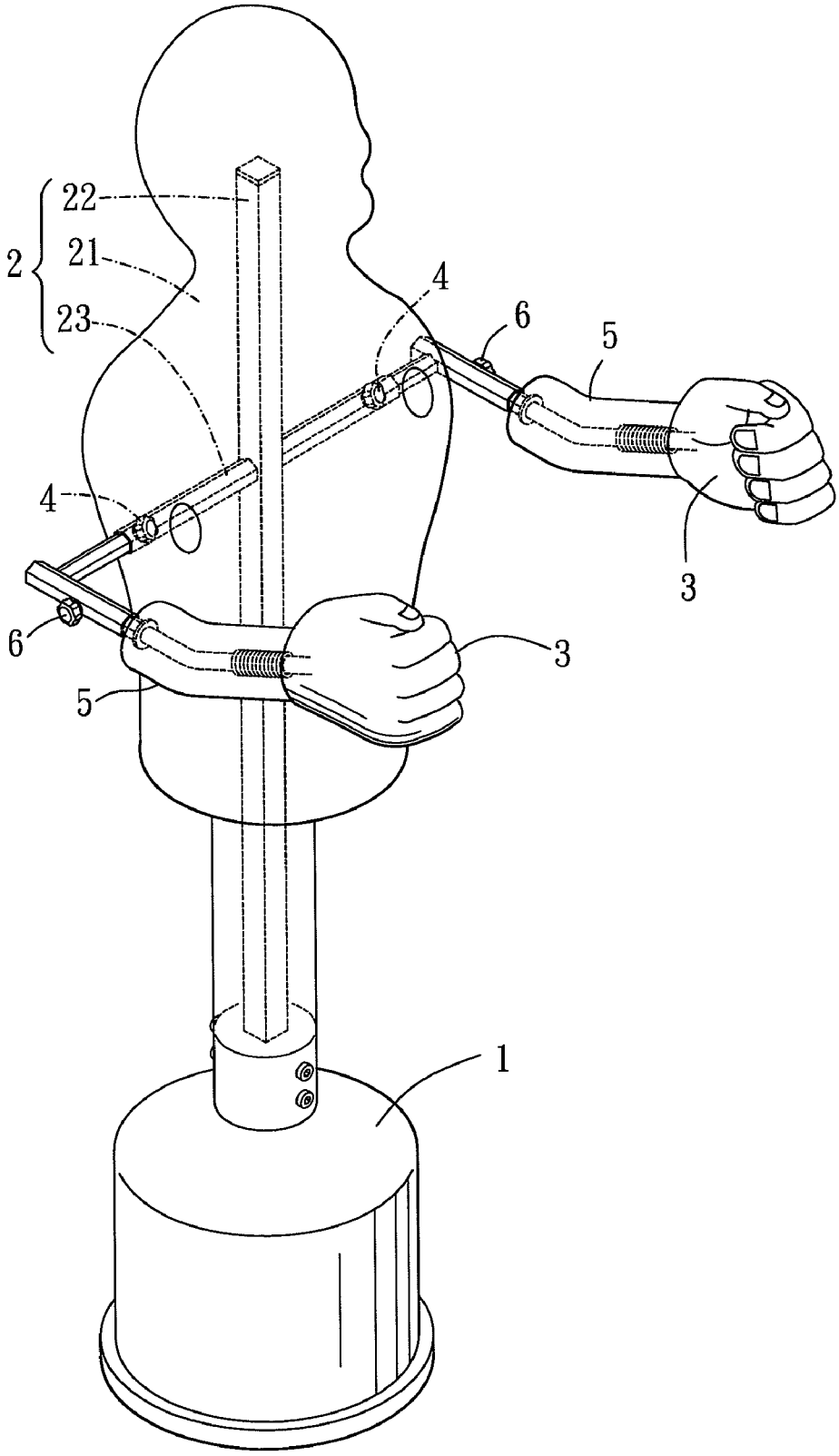
FIG. 1 is a perspective view showing a kung fu training device of the present invention.
Figures 2, 2A:
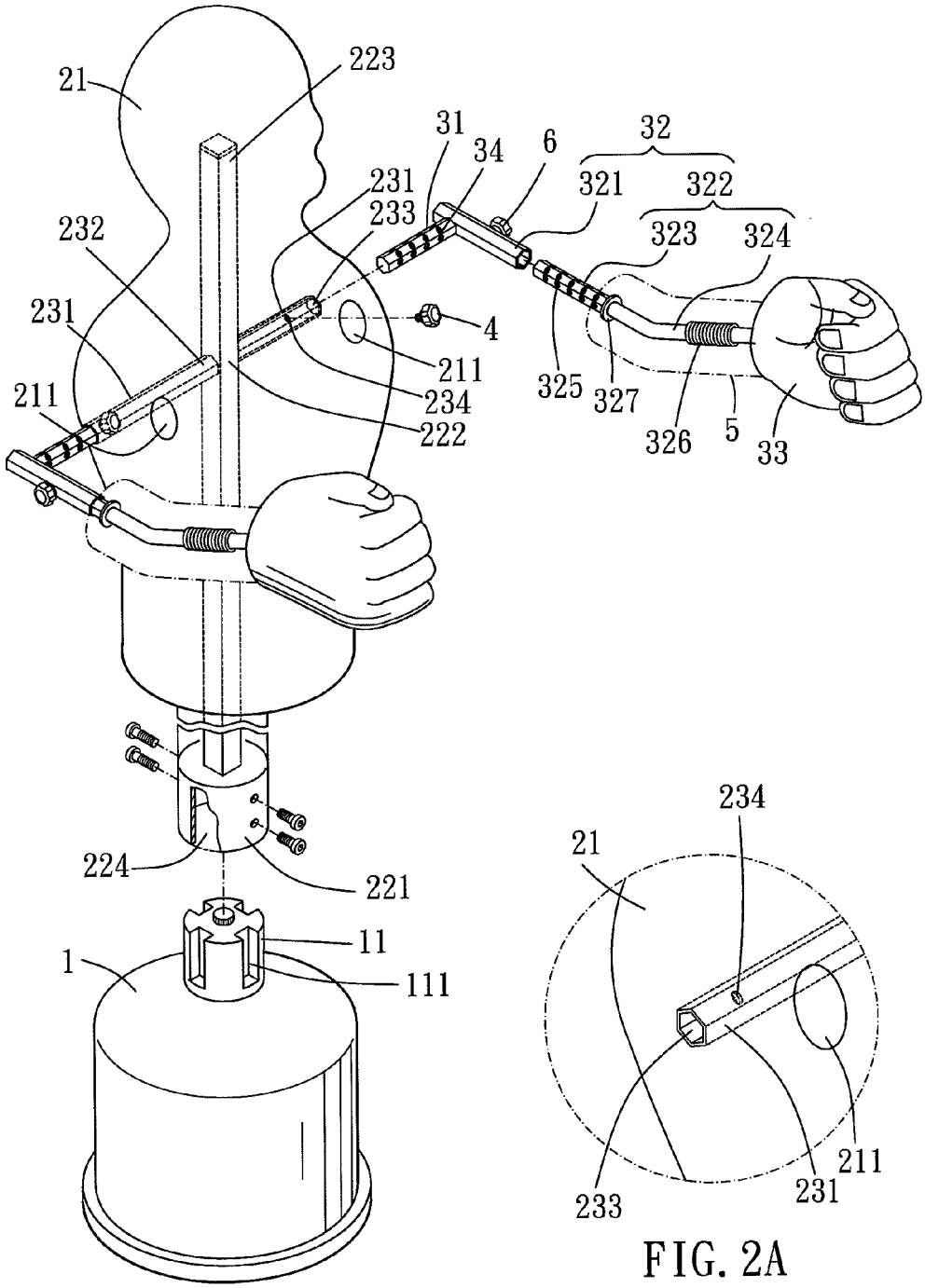
FIG. 2 is a breakdown drawing showing a kung fu training device of the present invention.
FIG. 2A is a partial enlargement perspective view showing the body portion of the present invention.

Please refer to FIG. 1 and FIG. 2 for an embodiment of the present invention. The Kung fu training device includes a base portion 1, a body portion 2, two arms 3, two first pins 4, two protecting pads 5 and two second pins 6.

The base portion 1 has a seat portion 11, which upwardly extends. The seat portion 11 is adapted for a rod or a socket to be disposed thereon. The seat portion 11 may be formed with several grooves 111. The base portion 1 has a considerable weight so that the center of gravity of the whole set of the kung fu training device lies within the periphery of the base portion 1. Preferably, the base portion 1 has an inner space to stuff liquid, such as water, or solid particles, such as sand, therein.

The body portion 2 includes a wrapping element 21, a vertical rod 22 and a lateral rod 23. The vertical rod 22 has a bottom end 221, a first body section 222 and a top end 223. The bottom end 221 is formed with a bottom hole 224. The bottom hole 224 and the vertical rod 22 are coaxial. The seat portion 11 is received in the bottom hole 224. Several screws are used to further fix the bottom end 221 and the seat portion 11. As such, the vertical rod 22, which is firmly disposed on the base portion 1, extends upwardly. The bottom end 221 may be formed with several ribs (not shown) to engage with the grooves 111 of the seat portion 11, so that the vertical rod 22 can not be rotated with respect to the base portion 1. The first body section 222 connects the bottom end 221 to the top end 223.

The lateral rod 23 has two pivoting end 231 and a second body section 232. The second body section 232 connects one of the pivoting ends 231 to the other. The second body section 232 is firmly disposed on the first body section 222. The lateral rod 23 and the vertical rod 22 are perpendicular to one another. Each pivoting end 231 is formed with a right polygonal hole 233 and a first fixation hole 234. The right polygonal holes 233 and the lateral rod 23 are coaxial. Each first fixation hole 234 communicates with its corresponding right polygonal hole 233.

The wrapping element 21 is foamed material. The wrapping element 21 covers the first body section 222, the top end 223, the pivoting ends 231 and the second body section 232. The bottom end 221 is not covered by the wrapping element 21. In other possible embodiments, the wrapping element 21 may cover the bottom end 221. But, the bottom hole 224 should still be uncovered. The right polygonal holes 233 are uncovered, so that the right polygonal holes 233 communicate with the surrounding. The wrapping element 21 is formed with two grooves 211. The grooves 211 communicate with the first fixation holes 234 respectively.

Both of the arms 3 include a right polygonal rod 31, a stretching rod 32 and a fist pad 33. Each right polygonal rod 31 has plurality of side surfaces. The side surfaces are parallel to the longitudinal direction of their corresponding right polygonal rod 31. The side surfaces are formed with sets of bores respectively. Each set of bores includes several first positioning holes 34. The first positioning holes 34 are arranged along the right polygonal rod 31. The profile of the right polygonal rods 31 and the profile of the right polygonal holes 233 correspond to one another, so that the right polygonal rods 31 are slidably received in the right polygonal holes 233, and the right polygonal rods 31 can not rotate with respect to the pivoting ends 231. Each first fixation hole 234 communicates with one of the first positioning holes 34.

The stretching rod 32 may include a sleeve 321 and a linking pole 322. The sleeve 321 is firmly disposed on the right polygonal rod 31. The sleeve 321 is not parallel to the right polygonal rod 31, so that a shoulder angle is defined by the right polygonal rod 31 and the stretching rod 32. Preferably, the shoulder angle is a perpendicular angle. The sleeve 321 is formed with a second fixation hole (not shown). The linking pole 322 has a first section 323 and a second section 324. The first section 323 is formed with plurality of second positioning holes 325. The first section 323 is received in the sleeve 321. The second fixation hole communicates with one of the second positioning holes 325. Each profile of the sleeve 321 and the first section 323 may be a right polygon. A forearm angle is defined by the first section 323 and the second section 324. The forearm angle may be 15 degrees, so that the arm portion 3 is similar to a human arm. The second section 324 has a coil spring 326. The coil spring 326 extends along the longitudinal direction of the second section 324. In other possible embodiments, the first section 323 may also have a coil spring. The linking pole 322 has a flange 327. The fist pad 33 is disposed on the second section 324, so that the stretching rod 32 connects its corresponding right polygonal rod 31 to its corresponding fist pad 33. In other possible embodiments, each stretching rod 32 may be a single hollow or solid rod.

The first pin 4 is removably inserted in the groove 211, the first fixation hole 234 and the first positioning hole 34, so that the right polygonal rod 31 and the pivoting end 231 are immovable with respect to each other. The first pin 4 may be threaded, and the first fixation hole 234 or the first positioning hole 34 may be threaded, too. As such, the first pin 4 can hardly leave the first fixation hole 234 and the first positioning hole 34 unexpected. Preferably, the first pin 4 is entirely received in the groove 211.

The protecting pad 5 is foamed material. The protecting pad 5 covers the linking pole 322. The protecting pad 5 can also cover the coil spring 326. Preferably, the protecting pad 5 is disposed between the flange 327 and the fist pad 33.

The second pin 6 is removably inserted in the second fixation hole and the second positioning hole 325, so that the sleeve 321 and the linking pole 322 are immovable with respect to each other. The second pin 6 may be threaded, and the second fixation hole or the second positioning hole 325 may be threaded, too. As such, the second pin 6 can hardly leave the second fixation hole and the second positioning hole 325 unexpected.

Figure 3:
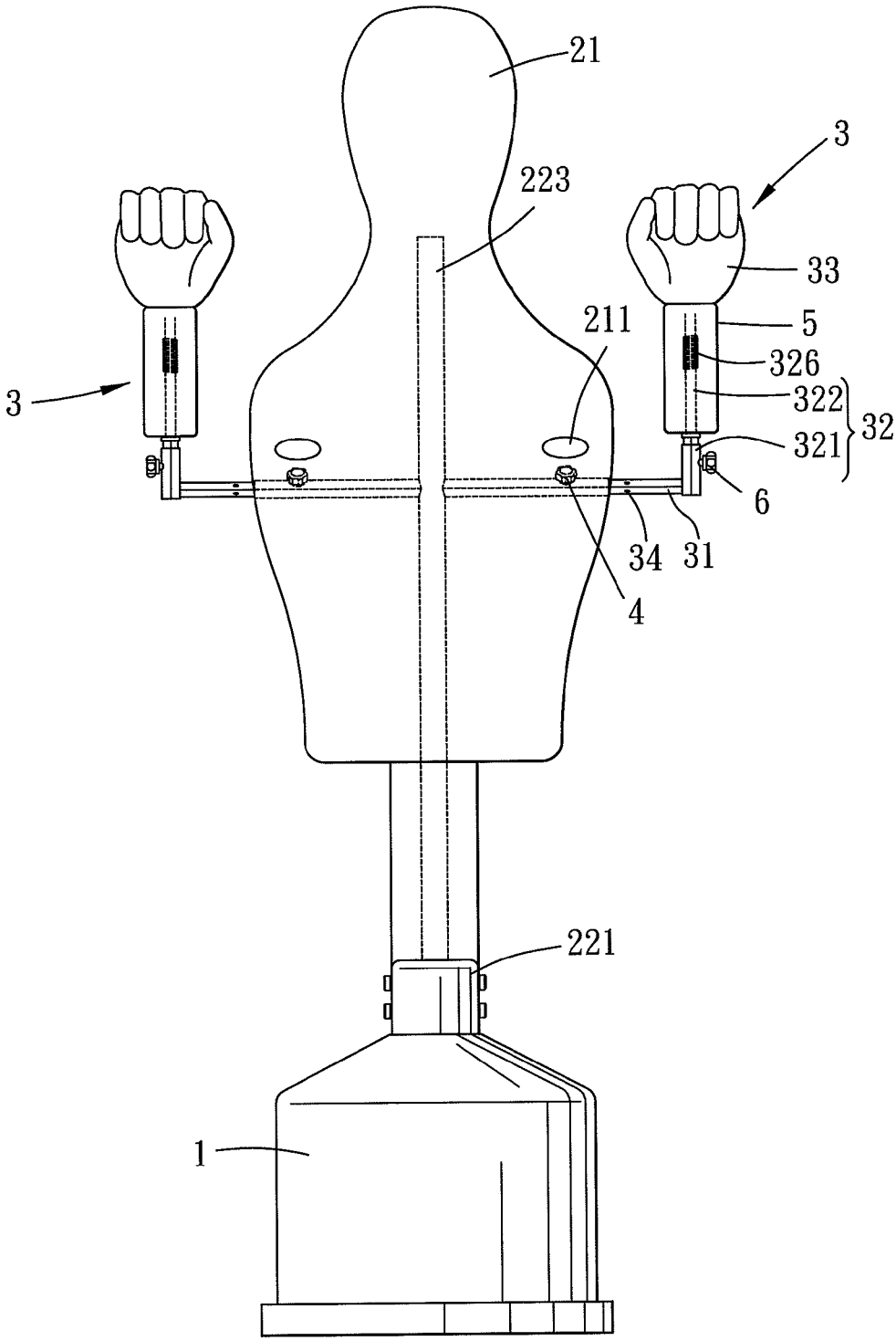
FIG. 3 is a front view showing a kung fu training device of the present invention.
Figure 4:
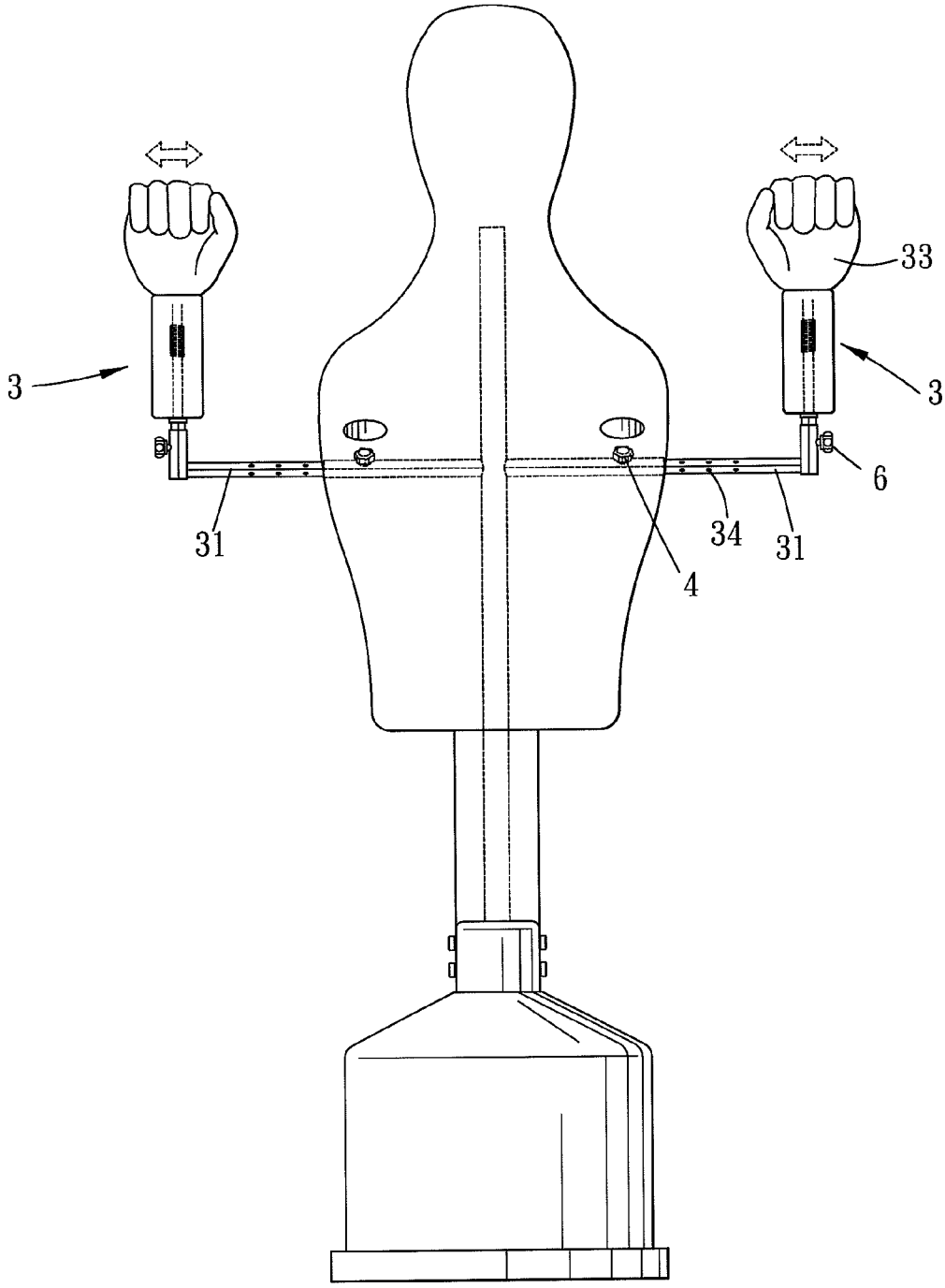
FIG. 4 is a front view showing a usage state of a kung fu training device of the present invention.
Figure 5:
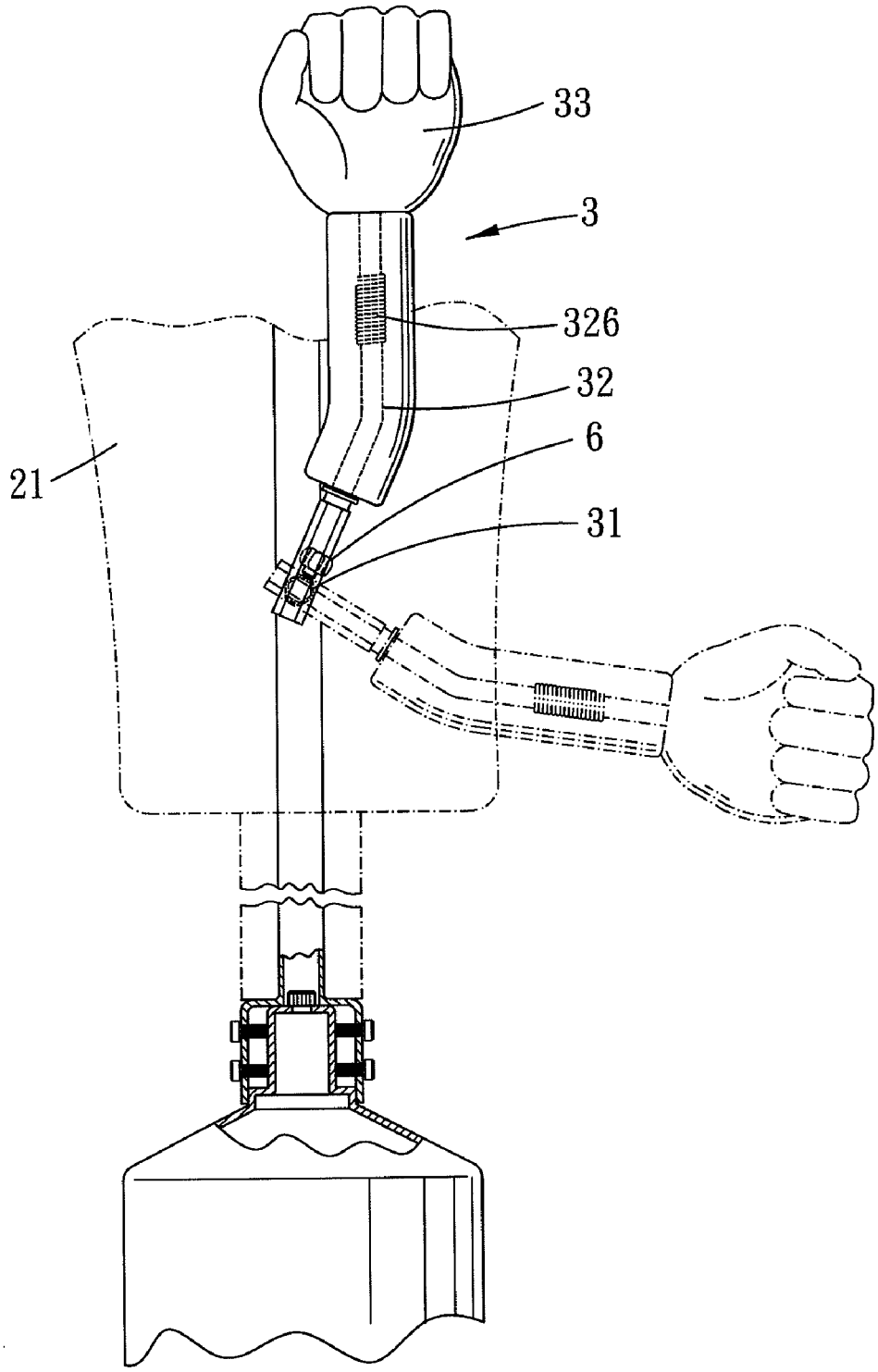
FIG. 5 is a side view showing another usage state of a kung fu training device of the present invention.

Accordingly, please refer to FIG. 3 and FIG. 4, the first pin 4 may insert in one first positioning hole 34 or the others of the same set of bores. Therefore, the right polygonal rod 31 can be received in the right polygonal hole 233 in several different depths. The distance between the two arms is adjustable. Similarly, the distance between the fist pad 33 and the right polygonal rod 31 is adjustable. Please refer to FIG. 5, the right polygonal rod can be drawn out from the right polygonal hole, and be reinserted into the right polygonal hole after it is rotated about its longitudinal direction. Therefore, the height or the angle of elevation of the arm 3 is adjustable.

What is claimed is:

1. A kung fu training device, comprising:

a base portion, having a seat portion extending upward;

a body portion, comprising a vertical rod, a lateral rod and a wrapping element, the vertical rod having a bottom end, a first body section and a top end, the bottom end being disposed on the seat portion, the first body section connecting the bottom end to the top end, the lateral rod having two pivoting ends and a second body section, the second body section connecting one of the pivoting ends to the other, the second body section being firmly disposed on the first body section, each pivoting end being formed with a right polygonal hole and a first fixation hole, the right polygonal holes and the lateral rod being coaxial, the first fixation hole communicating with its corresponding right polygonal hole, the wrapping element being foamed material, the wrapping element covering the first body section, the top end, the pivoting ends and the second body section, the wrapping element being formed with two grooves, each groove communicating with one of the first fixation holes, the right polygonal holes being uncovered, so that the right polygonal holes can communicate with the surrounding atmosphere;

two arms, each arm comprising a right polygonal rod, a stretching rod and a fist pad, each right polygonal rod having a plurality of side surfaces, each side surface being parallel to the longitudinal direction of the right polygonal rod, several of the side surfaces being formed with a set of bores, each set of bores comprising a plurality of first positioning holes, the first positioning holes of each set of bores being arranged along the right polygonal rod, each right polygonal rod being received in one the right polygonal holes, each first fixation hole communicating with one of the first positioning holes, a shoulder angle being defined by the right polygonal rod and the stretching rod, each stretching rod connecting its corresponding right polygonal rod to its corresponding fist pad; and two first pins, being removably inserted in the grooves, the first fixation holes and their corresponding first positioning holes, so that each right polygonal rod and their corresponding pivoting end being immovable with respect to each other.

2. The kung fu training device of claim 1, wherein each first pin is entirely received in its corresponding groove.

3. The kung fu training device of claim 1, wherein each stretching rod comprises a sleeve and linking pole, each sleeve is firmly disposed on one of the right polygonal rods, each sleeve is formed with a second fixation hole, each linking pole has a first section and a second section, each first section is received in its corresponding sleeve, each first section is formed with a plurality of second positioning holes, each second fixation hole communicates with one of the second positioning holes, each fist pad is firmly disposed on one of the second sections; the kung fu training device further comprises two second pins, the second pins are removably inserted in the second fixation holes and their corresponding second positioning holes, so that each sleeve and its corresponding linking pole are immovable with respect to each other.

4. The kung fu training device of claim 3, wherein a forearm angle is defined by the first section and the second section of each linking pole, the forearm angle is about 15 degrees.

5. The kung fu training device of claim 3, further comprising two protecting pads, each protecting pad being foamed material, each protecting pad covering one of the linking poles.

6. The kung fu training device of claim 5, wherein one of the first sections and the second sections has a coil spring, each coil spring is covered by its corresponding protecting pad.

7. The kung fu training device of claim 5, wherein each linking pole has a flange, the protecting pad is disposed between the flange and its corresponding fist pad.

* * * * *